United States Patent [19]

Oshinsky et al.

[11] 4,084,705

[45] Apr. 18, 1978

[54] LOCK FOR A RAILWAY VEHICLE COUPLER

[75] Inventors: Frank W. Oshinsky, McKeesport; Thomas R. Brown, Sr., Pittsburgh, both of Pa.

[73] Assignee: McConway & Torley Corporation, Pittsburgh, Pa.

[21] Appl. No.: 816,621

[22] Filed: Jul. 18, 1977

[51] Int. Cl.[2] ..... B61G 3/00

[52] U.S. Cl. ..... 213/127; 213/145; 213/146

[58] Field of Search ..... 213/109, 115, 119, 121, 213/122, 123, 125, 126, 127, 129, 131, 135, 136, 144–148

[56] References Cited

U.S. PATENT DOCUMENTS

| | | | |
|---|---|---|---|
| 3,433,369 | 3/1969 | Metzger | 213/136 |
| 3,698,570 | 10/1972 | Metzger | 213/127 |
| 3,972,421 | 8/1976 | De Penti | 213/127 |

*Primary Examiner*—Trygve M. Blix
*Assistant Examiner*—D. W. Keen
*Attorney, Agent, or Firm*—Thomas H. Murray

[57] ABSTRACT

In a railway vehicle coupler, the lock includes a leg portion depending from an upper lock body which is solid. The rear part of the upper lock body has a substantially vertical planar surface or stepped planar surfaces across the most rearwardly-extending surface. A beveled and substantially planar rear face or stepped planar rear faces commence at the lower edge of the vertical planar surface and extends downwardly and forwardly to the lock ledge at the guard-arm side of the lock. Above the vertical planar surface, there is a beveled rear surface with or without a step extending downwardly and forwardly from the rear guide at the knuckle side of the lock to the guard-arm side. This surface extends arcuately and commences at the upper edge of the vertical planar surface and extends to the top of the lock.

12 Claims, 10 Drawing Figures

LOCK FOR A RAILWAY VEHICLE COUPLER

BACKGROUND OF THE INVENTION

This invention relates to railroad couplers and, more particularly, to improvement in a lock element that not only reduces manufacturing costs but also enhances the dropping movement of the lock from an unlocked position to a locked position during closing of the knuckle.

The most common type of railroad coupler is an E-type railroad coupler having a horizontal key passing through a slotted opening in the side wall of the coupler shank. Other known forms of couplers include an F-type and an E/F-type wherein a vertical pin is passed through an opening in the shank of the coupler. There are many variations to these forms of couplers but each coupler is designed with the capability for either top or bottom operation by a lock-lift assembly. Different standard forms of linkage are used to move the lock element in the coupler for top and bottom modes of operation. In an E-type coupler, the lock is positioned with the capability for use in either the top or bottom mode of operation as a standard design dating back to 1931. However, during the last decade, only a small percentage of new railway cars are equipped with the suitable linkage for operation of the coupler from the top. Currently, couplers for railway vehicles are almost exclusively equipped for bottom operation. There are certain exceptions notably, for example, a relatively small percentage of couplers for locomotives.

With the foregoing in mind and the ever-present problem of reducing or at least maintaining the cost of couplers for railway vehicles within acceptable limits, it has been discovered that measures can be taken to reduce the cost of manufacturing the lock element for the coupler while at the same time improving the operation of the lock in the coupler. Heretofore, in a coupler for a railway vehicle, the lock element was manufactured from a casting with a lock-link slot and a link shaft formed as a cast structure through the use of a core and associated core-box equipment. The lock-link slot and link shaft, according to AAR standards, are located in the upper portion of the lock at the rear surface. The requirement for a core and associated core-box equipment to produce the lock-link slot and link, although rarely if ever used for the coupler operation, nevertheless consumed time and effort to workmen to clean and finish the casting. Moreover, as is known in foundry practice, when a core is used in conjunction with a patterned area, an unavoidable fin or offset occurs in the resulting casting. The fin or offset must be machined by grinding, for example, to meet standard profile requirements. Not only is manual grinding and chipping eliminated in this area of the lock, but also the required core and setting of the core to provide the link slot are eliminated. A more simplified pattern may be employed and inspection operations are reduced because gaging of the lock slot and shaft is eliminated. Also eliminated is the need to maintain a core box for the link core. While the improved lock element of the present invention brings about a realization of reduced production costs, it also enhances the operation of the coupler. The improved lock performs not only equally as well as the standard lock but also improved performance occurs particularly in regard to the essential dropping of the lock under gravity when the knuckle is moved to a locking position. In this regard, the improved lock has been found to drop more freely when the knuckle is closed, a function which is believed due to the fact that the improved lock has a weight which is increased by approximately 1.9 pounds over the weight of a standard lock and thereby changing its center of gravity more favorably.

SUMMARY OF THE INVENTION

It is, therefore, an object of the present invention to provide an improved lock element in a coupler for a railway vehicle to enhance the locking and unlocking modes of operation of the coupler and at the same time reduce the cost of manufacturing the locking element.

The invention resides in the provision of a continuous face surface profile across a solid part at the rear of an upper lock body portion of a lock in a coupler for a railway vehicle. The solid rear part of the upper lock body portion is always disposed to overlie a depending leg portion of the lock during locking of the knuckle to urge and maintain a lug extending laterally from the lock for sliding contact with a vertically-extending rib within the head of the coupler during dropping of the lock from an unlocked position.

According to the preferred form of the present invention, the lock is further characterized as to the continuous face surface profile on the rear part of the upper lock body portion by stepped and substantially vertical planar surfaces across the most rearwardly-extending surface of the upper lock body portion. Below these stepped planar surfaces, the continuous face surface profile across the rear part of the upper lock body portion is stepped with each stepped surface being beveled and substanially planar. At the guard arm side, the stepped surface extends downwardly and forwardly to a lock ledge on the lock. At the knuckle side, a raised part of the stepped surface forms a beveled planar surface. From the upper edge of the vertical planar surface, a beveled rear face extends from a stepped edge downwardly and forwardly from the middle part of the lock to the guard-arm side of the lock. This beveled rear face surface is arcuate commencing at the upper edge of the vertical planar surface and extending to the top of the lock. A projected arcuate surface extends from the upper edge of the vertical planar surface to the top of the lock from the middle part of the lock to the knuckle side thereof.

The lock, according to a further embodiment of the present invention, is characterized as to the continuous face surface profile on the rear part of the upper lock body portion by a substantially vertical planar surface across the most rearwardly-extending surface of the upper lock body portion. Below this vertical planar surface, the continuous face surface profile on the rear part of the upper lock body portion is beveled and substantially planar to extend downwardly and forwardly to a lock ledge on the lock at the guard-arm side thereof. From the upper edge of the vertical planar surface, a beveled rear face extends downwardly and forwardly from the rear guide to the guard-arm side of the lock. The latter beveled rear face surface is arcuate commencing at the upper edge of the vertical planar surface and extending to the top of the lock.

These features and advantages of the present invention as well as others will be more fully understood when the following description is read in light of the accompanying drawings, in which.

Figure 1:
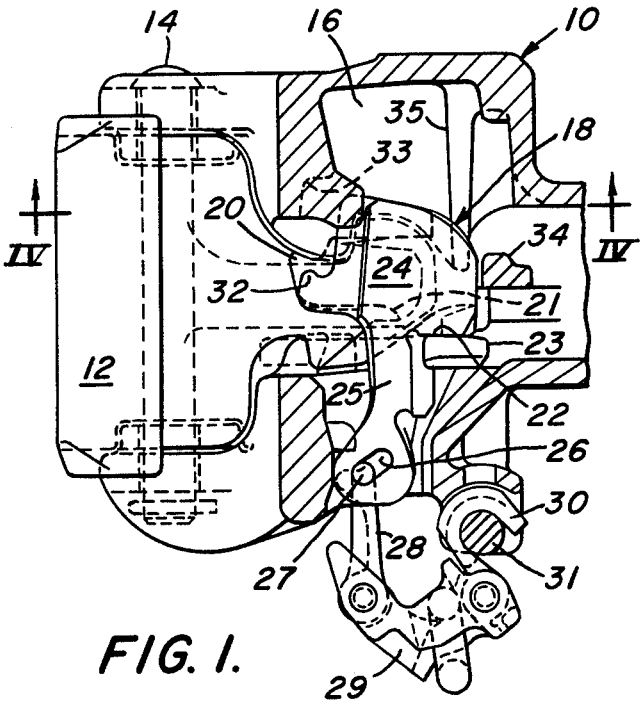
FIG. 1 is a side elevational view toward the knuckle side, partially in section, of a coupler embodying the improved lock element of the present invention with the lock shown in the locked position.

While a standard E-type coupler is shown in the drawings and selected for the purpose of disclosing the present invention, it will be understood by those skilled in the art that a lock embodying the features of the present invention is equally useful in E/F-type couplers.

As shown in FIGS. 1–4, the coupler includes a head 10 having a guard arm 11 on one side thereof and a knuckle 12 pivotally connected to the head at the side opposite the guard arm. A vertical knuckle pivot pin 14 couples the knuckle for pivotal movement to the head. The head 10 has a lock-receiving chamber 16. A lock 18 which embodies the features of the present invention is disposed in chamber 16. In the closed position of the knuckle, the lock is in its lowermost or locking position as seen in FIG. 1. The lock is interposed between one side of the knuckle tail 20 and the adjacent side lock wall on the guard-arm side of the coupler head. The lock 18 in its locking position, is supported partly on a support ledge 21 on the knuckle tail and partly on arm 22 of a knuckle thrower 23 as is well known in the art.

The lock 18 comprises an upper lock body portion 24 and a depending leg portion 25. An elongated slot 26 is provided in the lower end of the leg portion 25 for receiving a horizontal trunnion 27 at the upper end of a lock-lifter toggle 28. The lower end of toggle 28 is pivotally connected to the forward end of a connector 29 which includes a hook-shaped portion 30 supported on a horizontal trunnion 31 on the underside of the coupler head. The connector 29 is actuated by the usual uncoupling rod (not shown) to raise the lock from a locking relation with the knuckle tail 20 to permit the knuckle to be swung to open position.

Figure 2:
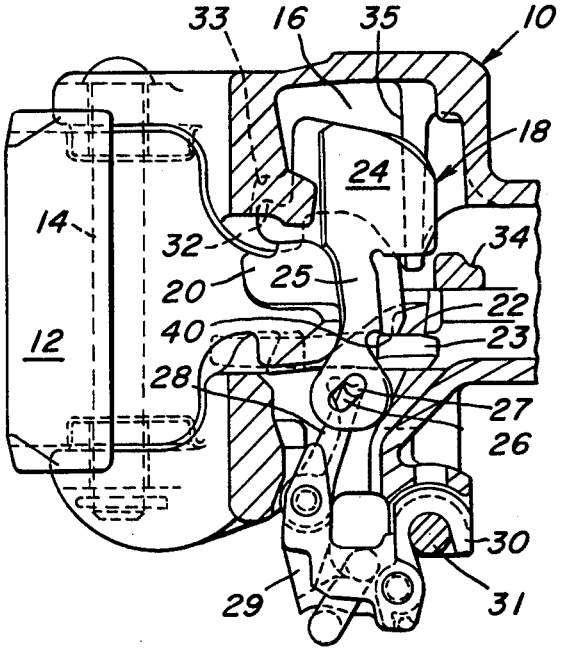
FIG. 2 is a view similar to FIG. 1 but illustrating the knuckle in the closed position with the lock located in an unlocked, lock-set position.
Figure 3:
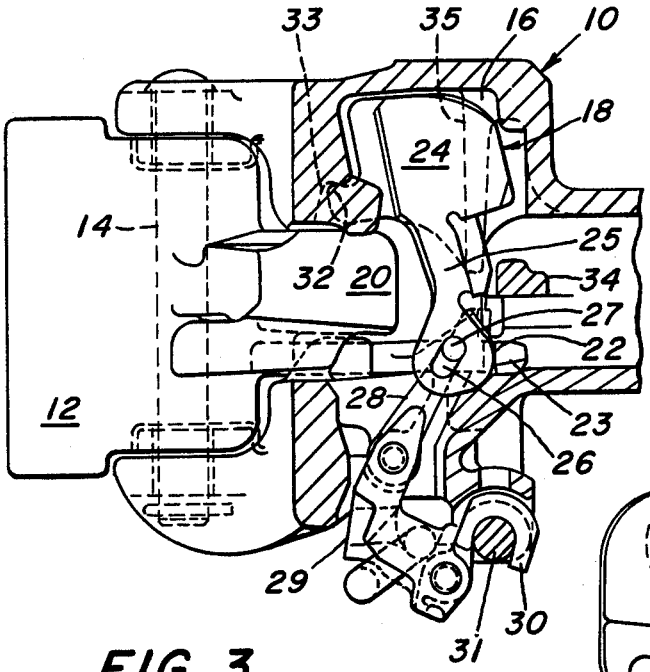
FIG. 3 is a view similar to FIG. 2 but illustrating the knuckle in the open position with the lock raised up to the fully unlocked position.
Figure 4:
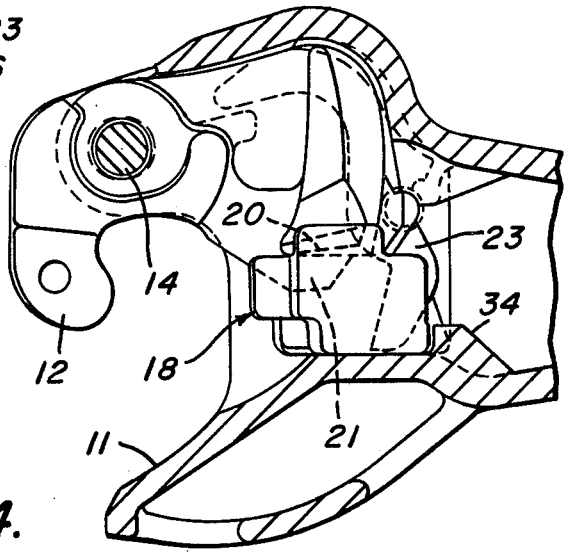
FIG. 4 is a horizontal sectional view taken along line IV—IV of FIG. 1.

In FIG. 3, the knuckle 12 is shown in the open position and lock 18 is in the upper end of chamber 16. The upper body portion 24 of the lock is above the top of the knuckle tail 20. The position of the lock 18 shown in FIG. 2 is referred to in the art as the lock-set position with the lock set seat 40 of the lock leg 25 resting on top leg face 22 of thrower 23. The knuckle 12 can be revolved about the pin 14 such that the knuckle swings to an open position as may typically occur when the nose of a knuckle of a mating coupler exerts a forward pull as a leading railway car is pulled away. As in FIG. 3 by actuating the linkage coupled to the bottom of the lock, further lifting of the lock occurs, thus raising it to an unlocked position wherein a fulcrum 32 on the front side of the lock engages a shoulder 33 in the front wall of the housing. The continued application of a thrust forces the lock to rotate about its fulcrum driving the leg 25 of the lock rearwardly. The leg of the lock engages the leg of thrower 23 causing rotation thereof. This, in turn, produces movement of the knuckle about pin 14 into an open position. Upon closing of the knuckle from the unlocked as well as the lock-set position, the lock will drop by gravity to lock the knuckle as shown in FIG. 1. In the locking position, the lock is retained against rearward displacement by a lug 34 which projects laterally into the lock chamber 16 from the side wall at the guard-arm side of head 10. The lug 34 is directly rearward of the upper lock body portion 24 which has a continuous face surface profile, as will be more fully described hereinafter, in an opposed relation with the surface of the lug. A vertically-extending lock guide rib 35 extends into chamber 16 from the side wall of the coupler head at the knuckle side. Rib 35 extends downwardly from the top wall of the head to about a point midway between the top and bottom of lug 34. The inwardly-facing surface of the rib terminates in close proximity to the side wall of the upper lock body portion directed toward the knuckle side of the coupler housing. The rib 35 limits lateral displacement of the lock during vertical travel within the lock-receiving chamber.

In each of the locks shown in FIGS. 5–7 and 8–10, a laterally-extending lug 36 projects from the upper lock body portion 24 of the lock at the knuckle side. This lug 36 defines a rear guide surface 37 which is adapted to engage the forward face of rib 35 to limit rearward tilting of the lock during vertical movement thereof within the lock-receiving chamber between the thrown, lock-set and locked positions.

The lock leg 25 includes at its rear surface a lock-set seat 40 which is a generally horizontal ledge located about midway between the bottom end of the leg and a thrower seat 41 which is also a generally horizontal ledge at the back surface of the lock. The thrower seat typically defines a line of demarcation between the depending leg 25 and the upper lock body portion 24. As described above, the fulcrum 32 projects from the front face of the portion 24. In each lock embodiment of the present invention, the top and rear faces of the upper lock body portion form limiting surfaces to a solid mass of metal between the guard-arm side and the knuckle side of the lock. The usual lock-link slot and link shaft are eliminated whereby an increased weight of cast metal of the order of 1.9 pounds is located in an overhanging relation at the rear of the upper lock body portion 24 with respect to the depending leg 25. The smoother mode of operation of the lock, particularly during dropping of the lock into a locked position, is attributed to the increased weight overhanging the depending leg producing a resulting force that urges and maintains the rear guide surface 36 engaged for sliding contact with rib 35 during dropping movement of the lock.

Figure 6:
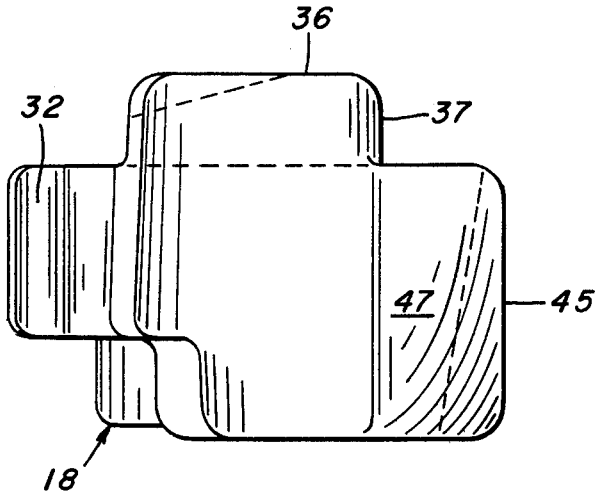
FIG. 6 is a plan view of the lock shown in FIG. 5.
Figure 5:
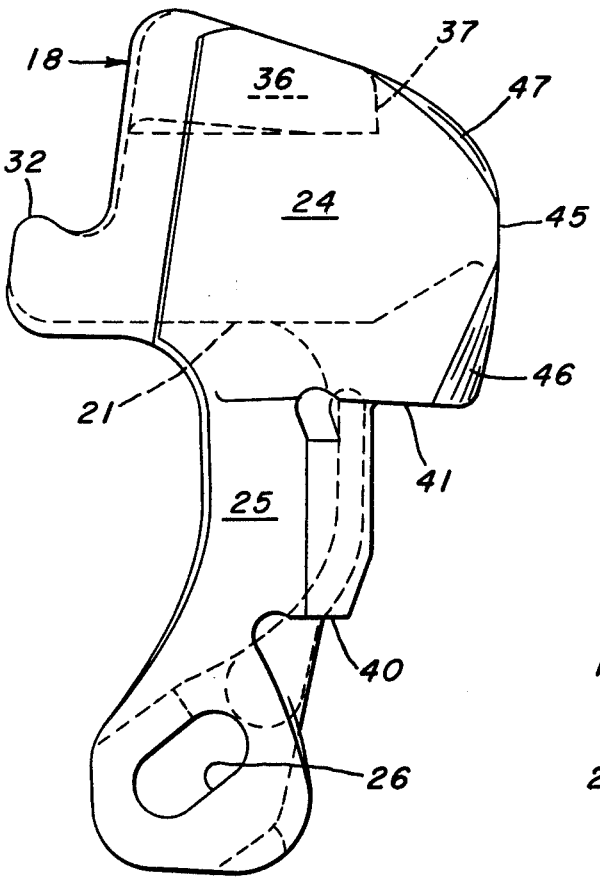
FIG. 5 is an elevational view of the guard-arm side of a lock embodying the features of the present invention.
Figure 7:
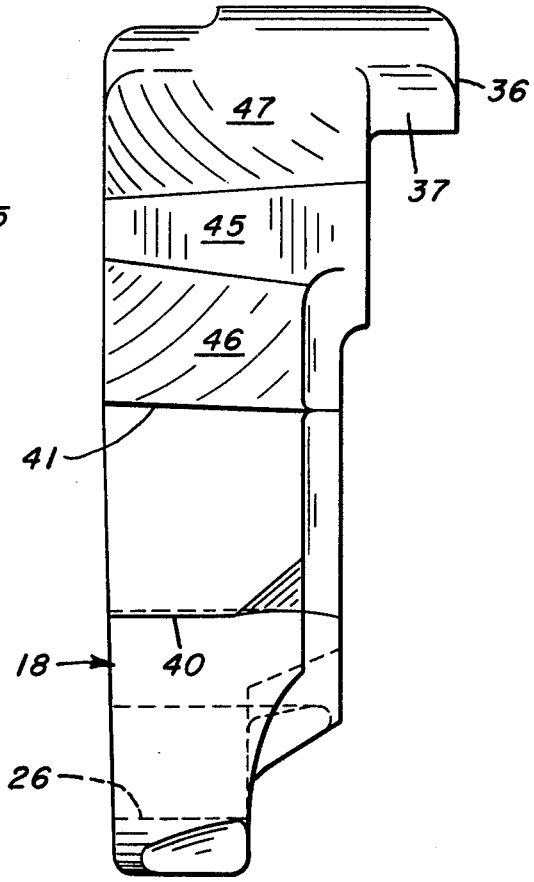
FIG. 7 is an end elevational view of the lock shown in FIG. 5.

According to one embodiment of the present invention, as shown in FIG. 5–7, the continuous face surface profile on the rear part of the upper lock body 24 portion includes a substantially vertical planar surface 45 across the most rearward extending surface of portion 24. A beveled and substantially planar rear face 46 commences at the lower edge of the vertical planar surface 45 and extends downwardly and forwardly to the guard-arm side of the lock. The rear face surface 46 terminates at the thrower seat 41. Surface 46 is directly opposed to the inward facing surface on lug 34 (FIG. 1) when the lock is in its locked position and during movement to this position. The surface 46 along the guard-arm side avoids contact with lug 34 by the leading edge between surface 46 and thrower seat 41 during downward movement of the lock. This assures a smooth transition of an opposing face-to-face relation between lug 34 and surface 46. Above the upper edge of the vertical planar surface 45, a beveled rear face 47 extends from the knuckle side of the guard-arm side of the lock. The beveled surface is developed on an arcuate contour that commences at the upper edge of the vertical planar surface and extends to the top of the body portion of the lock. Surface 47 assures a smooth and orderly movement of the lock within the lock chamber.

Figure 9:
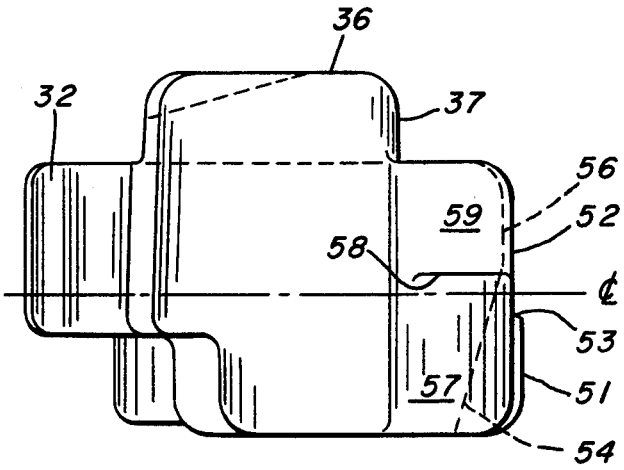
FIG. 9 is a plan view of the lock shown in FIG. 8.
Figure 8:
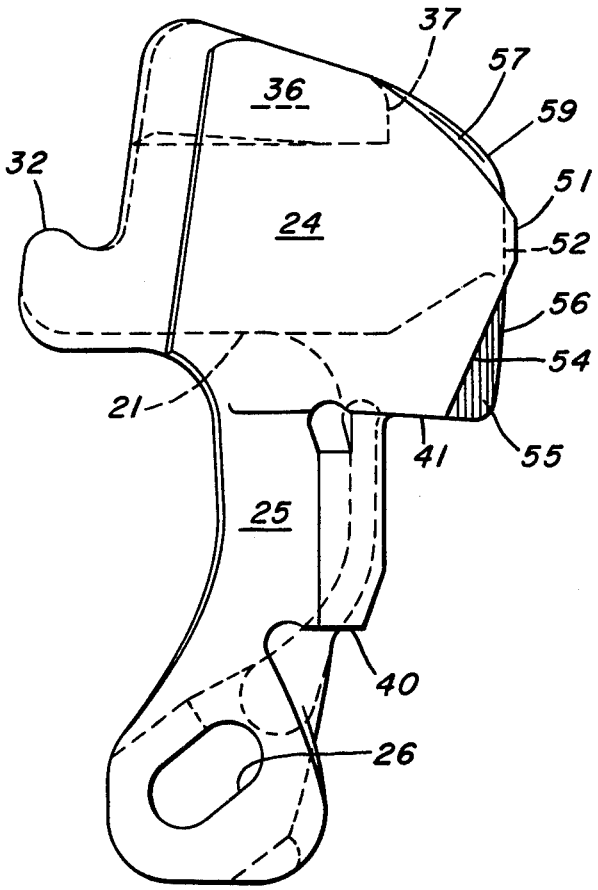
FIG. 8 is an elevational view of the guard-arm side of a lock according to a preferred embodyment of the present invention.
Figure 10:
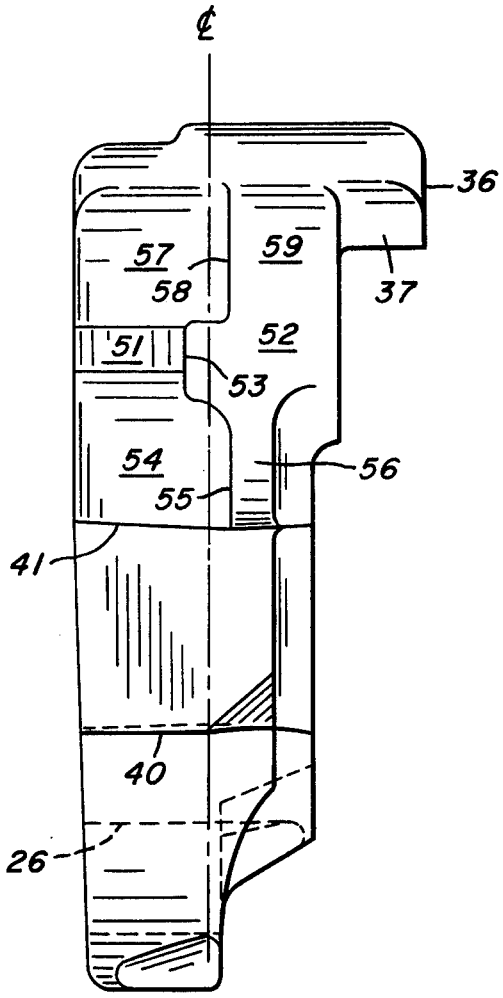
FIG. 10 is an end elevational view of the lock shown in FIG. 8.

According to a preferred embodiment of the present invention, as shown in FIGS. 8–10, the continuous face surface provile on the rear part of the upper lock body 24 portion includes, in the preferred form, stepped and substantially vertical planar surfaces 51 and 52 across the most rearward extending surface of portion 24. Surface 51 projects rearwardly with respect to surface 52. A ledge 53 is formed at about ¼ inch from the center line of the lock toward the guard-arm side. A beveled and substantially planar rear face surface 54 commences at the lower edge of the vertical planar surface 51 and extends downwardly and forwardly to the guard-arm side of the lock. The rear face surface 54 terminates at the thrower seat 41. Surface 54 is directly opposed to the inward facing surface on lug 34 (FIG. 1) when the lock is in its locked position and during movement to this position. A ledge 55 is located about ¼ inch from the center line of the lock toward a beveled and substantially planar rear face surface 56 extends from ledge 55 to the knuckle side of the lock. Surface 56 blends with surface 52 and terminates at thrower seat 41. A smooth transition of an opposing face-to-face relation between lug 34 and surface 54 occurs during downward movement of the lock. Above the upper edge of the vertical planar surface 51, a beveled rear face 57 extends from a ledge 58 to the guard-arm side of the lock. Ledge 58 is about ¼ inch toward the knuckle side of the lock from the center line thereof. The beveled surface 57 is developed on an arcuate contour that commences at the upper edge of the vertical planar surface 51 and extends to the top of the body portion of the lock. A beveled surface 59 extends from ledges 58 toward the knuckle side. The beveled surface 59 is developed on an arcuate contour that commences at the upper edge of the vertical planar surface 51 and extends to the top of the body portion of the lock.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. In a coupler for a railway vehicle including a head having a lock-receiving chamber, a knuckle and a knuckle thrower supported by said head for movement between open and locked positions, said knuckle thrower being movable with said knuckle toward their locked positions, said head having a guard arm on the side thereof opposite said knuckle, a lock including a leg portion depending from an upper lock body portion which is movable within said lock-receiving chamber between thrown, lock-set and locked positions, a lock ledge on the rear bottom part of said upper lock body portion engaging said knuckle thrower while said knuckle is in a locked position, said lock being movable upwardly in said chamber to said lock-set and thrown positions relative to said knuckle thrower and dropped by gravity toward its locked position when said knuckle is swung to its locked position, a lock-lift assembly including a toggle for moving said lock toward its lock-set position and movable with said lock toward its locked position, a vertically-extending guide rib in said chamber on the knuckle side of said head, said upper lock body portion having on one side thereof at its upper end a laterally-extending lug defining a guide surface adapted to engage said rib to guide the lock and limit rearward tilting thereof during downward movement of the lock toward the locked position, lug means in said head on the guard-arm side thereof extending laterally into said chamber to a point directly rearward of said upper lock body portion when the lock is in said locked position, the rear part of said upper lock body portion being solid with a continuous face surface profile substantially across the width thereof between said lock ledge and the top surface of said lock, the solid rear part of the upper lock body portion being disposed to always overhang said leg portion of the lock during locking of the knuckle to urge and maintain said laterally-extending lug engaged for sliding contact with said rib during dropping of the lock from said unlocked position.

2. The coupler according to claim 1 wherein said continuous face surface profile on the rear part of said upper lock body portion is further characterized by a substantially vertical planar surface across the most rearwardly-extending surface of the upper lock body portion.

3. The coupler according to claim 2 wherein said continuous face surface profile on the rear part of said upper lock body portion is further characterized by a beveled and substantially planar face commencing at the lower edge of said vertical planar surface and extending downwardly and forwardly to said lock ledge at the guard-arm side of the lock.

4. The coupler according to claim 2 wherein said continuous face surface profile on the rear part of said upper lock body portion is further characterized by a beveled rear face above the upper edge of said vertical planar surface and extending downwardly and forwardly from said rear guide to the guard-arm side of said lock.

5. The coupler according to claim 4 wherein said beveled rear face extends arcuately commencing at the upper edge of said vertical planar surface and extending to the top body portion of the lock.

6. The coupler according to claim 1 wherein said continuous face surface profile on the rear part of said upper lock body portion is further characterized by stepped and substantially vertical planar surfaces across the most rearwardly-extending surface of the upper lock body portion.

7. The coupler according to claim 6 wherein said continuous face surface profile on the rear part of said upper lock body portion is further characterized by a beveled and substantially planar face commencing at the lower edge of said vertical planar surface and extending downwardly and forwardly to said lock ledge at the guard-arm side of the lock.

8. The coupler according to claim 7 wherein said beveled and substantially planar face extends from the guard-arm side of the lock beyond the center line thereof to a ledge from which a raised beveled surface commences at the lower edge of said vertical planar surface and extends downwardly to said lock ledge at the knuckle side of the lock with respect to said center line.

9. The coupler according to claim 6 wherein said continuous face surface profile on the rear part of said upper lock body portion is further characterized by a beveled rear face above the upper edge of said vertical planar surface and extending downwardly and forwardly to the guard-arm side of said lock.

10. The coupler according to claim 9 wherein said beveled rear face extends arcuately commencing at the upper edge of said vertical planar surface and extending to the top body portion of the lock.

11. The coupler according to claim 9 wherein said beveled rear face extends from the guard-arm side of the lock beyond the center line thereof to a ledge from which a raised beveled surface extends to the knuckle side of the lock.

12. The coupler according to claim 11 wherein said raised beveled surface extends arcuately commencing at the upper edge of said vertical planar surface and extending to the top body portion of the lock.

* * * * *